US005167187A

United States Patent [19]

Dettinger et al.

[11] Patent Number: 5,167,187

[45] Date of Patent: Dec. 1, 1992

[54] THROW-ON/THROW-OFF DEVICE FOR A BLANKET CYLINDER IN THE PRINTING UNIT OF A SHEET-FED OFFSET PRESS

[75] Inventors: Dietrich Dettinger, Heusenstamm; Roland Holl, Weiterstadt, both of Fed. Rep. of Germany

[73] Assignee: MAN Roland Druckmaschinen AG, Fed. Rep. of Germany

[21] Appl. No.: 691,223

[22] Filed: Apr. 25, 1991

[30] Foreign Application Priority Data

Apr. 25, 1990 [DE] Fed. Rep. of Germany ..... 4013075

[51] Int. Cl.[5] ..... B41F 13/24

[52] U.S. Cl. ..... 101/218; 101/247

[58] Field of Search ..... 101/247, 218; 400/154.1, 155, 155.1, 179, 180, 181, 164.1

[56] References Cited

U.S. PATENT DOCUMENTS

| | | | |
|---|---|---|---|
| 859,575 | 7/1907 | Otto | 400/180 |
| 3,067,674 | 12/1962 | Tyma, Jr. et al. | 101/218 |
| 3,977,320 | 8/1976 | Lupkas et al. | 400/155 |
| 4,063,504 | 12/1977 | Ottenhues et al. | 101/247 |
| 4,218,972 | 8/1980 | Fujishiro | 101/218 |
| 4,415,284 | 11/1983 | Floyd | 400/179 |

*Primary Examiner*—Edgar S. Burr
*Assistant Examiner*—Lynn D. Hendrickson
*Attorney, Agent, or Firm*—Leydig, Voit & Mayer

[57] ABSTRACT

A throw-on and throw-off device for a blanket cylinder in the printing unit of an offset press is provided wherein the blanket cylinder is mounted at both its ends in eccentric bushings and the pivoting throw-on/throw-off movement of the bushings is produced by a toggle-like linkage. Two parallel double-acting fluid pressure cylinders are connected by way of their piston rods to a cross link which is pivoted to one of the links of the toggle linkage. The two pressure cylinders can be individually supplied with compressed air either consecutively or simultaneously so that, in the first case, precise sequential throw-on of the blanket cylinder on the plate cylinder and subsequently on the impression cylinder can be achieved and, in the latter case, there can be a very rapid throw-off of the blanket cylinder from both the impression cylinder and the plate cylinder.

3 Claims, 4 Drawing Sheets

THROW-ON/THROW-OFF DEVICE FOR A BLANKET CYLINDER IN THE PRINTING UNIT OF A SHEET-FED OFFSET PRESS

CROSS-REFERENCE TO RELATED APPLICATION

The present application is related to co-pending U.S. patent application Ser. No. 690,654, filed Apr. 24, 1991, which is hereby incorporated by reference.

FIELD OF THE INVENTION

The present invention relates generally to rotary offset printing presses and more particularly concerns a blanket cylinder throw-on/throw-off device for such presses.

BACKGROUND OF THE INVENTION

It is already known in the prior art, for example, from DE-PS 934,407 to throw on to the impression cylinder the eccentric bushing mounted blanket cylinder of the printing unit of an offset press in two separate phases with a freely determinable interval between them. The blanket cylinder is first thrown on to the plate cylinder for pre-inking and only afterwards is thrown on to the impression cylinder. This is achieved by a cam-operated cam follower lever having a two-state pawl coupling. Throw-on and throw-off are effected when the grip edges of the cylinders are opposite one another. A disadvantage of arrangements such as these is the unfavorable mechanical dynamics, due to the harsh engagement of the pawl and the corresponding high driving torque which must be additionally provided by the main drive, particularly when the presses are running fast.

For two stage throw-on and throw-off of the blanket cylinder without the need for an abrupt input of torque from the main drive, it is known from DE 3,232,171 A1 and from DD 86,631 to produce the movement of the eccentric bushings by means of double-acting, fluid pressure working cylinders adapted to operate consecutively. Disadvantages here, however, arise from the very high constructional complexity and the accompanying mass of the components which are associated with the blanket cylinder bearing levers, and the fact that the operation of the working cylinders corresponds to a pure series or consecutive arrangement so that the force evolved by one cylinder always reacts on the other cylinder cooperating with it.

In U.S. Pat. No. 3,067,674 a throw-on/throw-off device is disclosed having a fluid pressure actuating cylinder which acts on a toggle transmission linkage, the latter in turn pivoting the eccentric bushings of the blanket cylinder. A disadvantage in this case is that a three-point working cylinder is necessary for two-stage throw-on and throw-off. Such a cylinder corresponds essentially to a series arrangement of two double-acting working cylinders and needs to provide substantial forces for modern high-speed presses to ensure that the blanket cylinder separates fast enough from the impression cylinder at high printing speeds in the event a sheet to be printed is missing.

OBJECTS AND SUMMARY OF THE INVENTION

It is therefore the primary aim of the present invention to provide an improved throw-on/throw-off device for a blanket cylinder wherein two-stage thrown-on and throw-off can be provided by a relatively simple construction and wherein throw-off is rapid and reliable particularly in the case of high-speed presses.

In accordance with the present invention, two parallel double-acting fluid pressure cylinders are connected by way of their piston rods to a cross link which is pivoted to one of the links of a toggle linkage connected to the eccentric bushing of the blanket cylinder. The two pressure cylinders can be individually supplied with compressed air either consecutively or simultaneously so that, in the first case, precise sequential throw-on of the blanket cylinder on the plate cylinder and subsequently on the impression cylinder can be achieved and, in the latter case, there can be a very rapid throw-off of the blanket cylinder from both the impression cylinder and the plate cylinder.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 2 is a similar view showing the device according to the invention when thrown on;

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
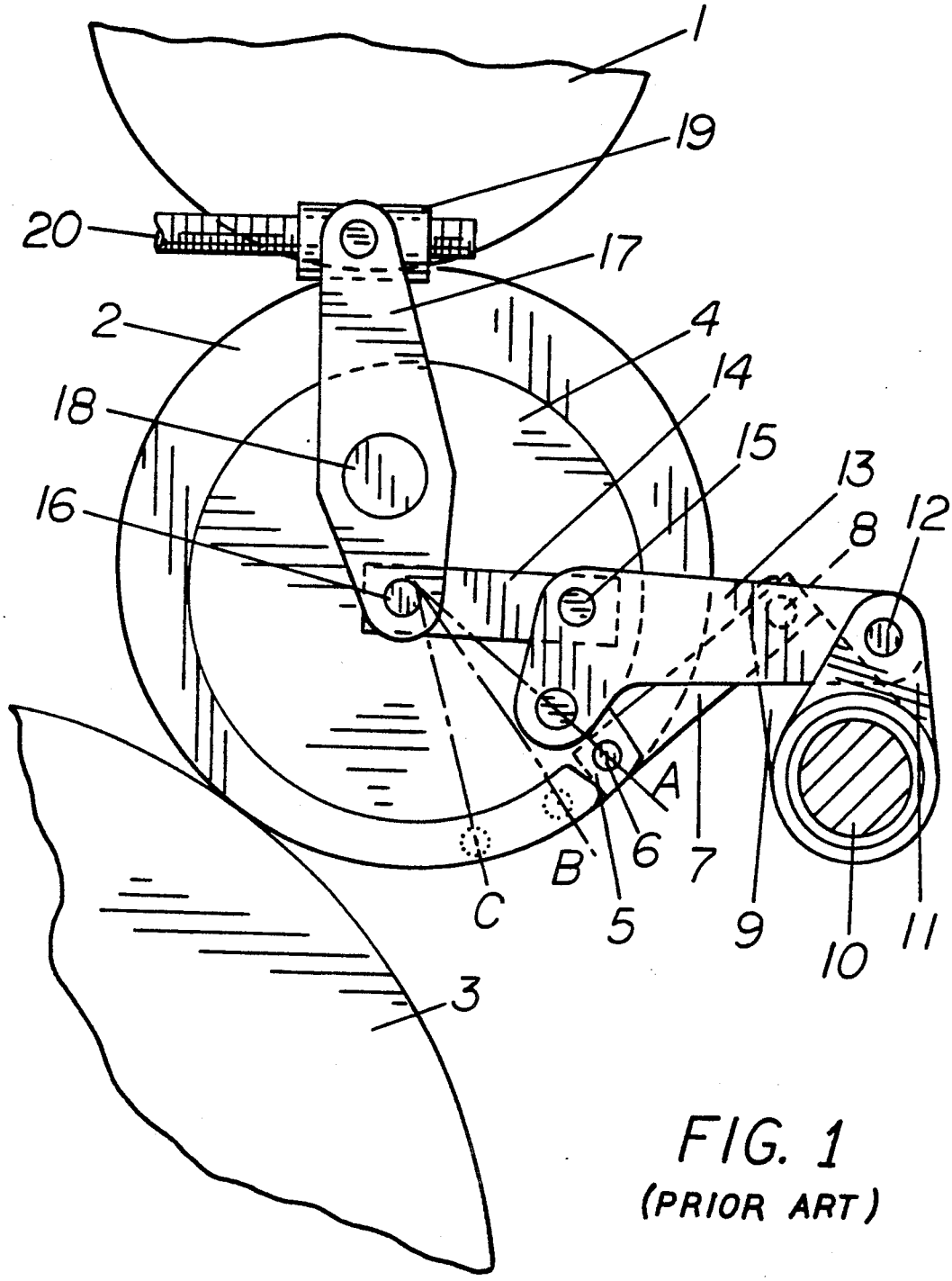
FIG. 1 (PRIOR ART)
FIG. 1 is a simplified side elevation view of a prior art throw-on throw-off device.

Turning now to the drawings, FIG. 1 shows a portion of a printing unit of an offset printing press, the unit comprising a plate cylinder 1, a blanket cylinder 2 and an impression cylinder 3. It will be understood that the cylinders are mounted at each end by way of their journals in the frame walls of the press. For throw-on and throw-off, the blanket cylinder 2 is mounted at both its ends in eccentric bushings 4. The blanket cylinder 2 can be thrown-on and thrown-off the cylinders 3 and 1 by pivoting of the bushings 4 with the prior art toggle-like linkage illustrated in FIG. 1, as described below.

In modern offset presses the throw-on procedure starting from the suspension of printing proceeds as follows:

When the gripper edges of the plate cylinder 1 and blanket cylinder 2 correspond to one another—i.e., the gripper edges of both cylinders are opposite one another—rotation of the bushings 4 through a predetermined angle throws the blanket cylinder 2 on to the plate cylinder 1. The blanket cylinder 2 then co-rotates with the plate cylinder 1 until the blanket cylinder 2 has received optimum inking and the first sheet to be printed has reached the impression cylinder 3. When the gripper edges of the cylinders 2 and 3 correspond to one another, the bushings 4 are rotated further for print throw-on, and so the first sheet on the impression cylinder 3 is printed.

FIG. 1 shows three angular positions A, B and C of the bushing 4 and of a lug 5 secured thereto. In position A, the three cylinders 1, 2 and 3 are in contact with one another. In position B, the cylinders 1 and 2 are still in contact with one another whereas the cylinders 2 and 3 have separated from one another. Position C corresponds to full throw-off and the blanket cylinder 2 is out of contact with the other cylinders 1 and 3 and a gap between it and the impression cylinder 3 is the largest.

In the event even one sheet is missing on the impression cylinder 3, when the gripper edges of the blanket cylinder 2 and the impression cylinder 3 are opposite one another, the bushing 4 is turned from position A to position B to prevent printing ink on the impression cylinder 3, in the absence of a sheet. If printing is to be suspended completely, corresponding to a prolonged interruption, the bushing 4 is turned to position C when the gripper edges of the plate cylinder 1 and the blanket cylinder 2 are opposite one another, to avoid over-inking of the blanket cylinder 2.

To enable the bushings 4 to be rotated, each bushing has a lug 5 secured by a pivot pin 6 to a link 7 and the latter is connected by way of a pivot pin 8 to a throw-off lever 9 of a throw-off shaft 10. The throw-off shaft 10 extends over the width of the press and is mounted in the two frame walls of the press. It will be understood that one of the quadrilateral linkages formed by the bushing 4, lug 5, lever 9 and link 7 is disposed on each side of the press. Consequently, by appropriate turning of the shaft 10, the bushings 4 on the two journals of the blanket cylinder 2 can be turned to the positions A, B and C; and, correspondingly, the axis of the blanket cylinder 2 is movable parallel to the axes of the other cylinders.

In order to rotate the shaft 10 a second lever 11 is secured to it on one side of the press. A toggle-like linkage mechanism embodied by links 13 and 14 and a pivot pin 15 is connected by way of a pivot pin to the second lever 11. The other link 14 of the toggle mechanism is connected by a pivot pin 16 disposed in one arm of a pressure adjustment lever 17. The lever 17 is mounted for rotation around a pin 18 rigidly secured to the press frame.

In the throw-on position, with the lug 5 of bushing 4 in position A, the toggle mechanism embodied by the links 13 and 14 takes up an extended position—i.e., the pivot pins 12, 15 and 16 are disposed substantially on a straight line. In this thrown-on position, the pressure with which the blanket cylinder 2 engages the impression cylinder 3 is adjustable by means of the lever 17. For this purpose, a spindle nut 19 is disposed on the top arm of the lever 17 and is driven by an adjusting spindle 20 that bears axially and non-displaceably on the press frame and is adjustable by a handwheel or the like on the outside of the press. By way of the lever 17, the extended toggle mechanism 13, 14 and the shaft 10, rotation of the spindle 20 rotates the bushings 4 and, therefore, adjusts the force with which the blanket cylinder 2 bears on the impression cylinder 3. Position A therefore corresponds to a particular pressure setting between the blanket cylinder 2 and the impression cylinder 3. Positions B and C of the bushings 4 and the lug 5, therefore, always relate to position A—i.e., they vary therewith according to different pressures between the cylinders 2 and 3.

Figure 2:
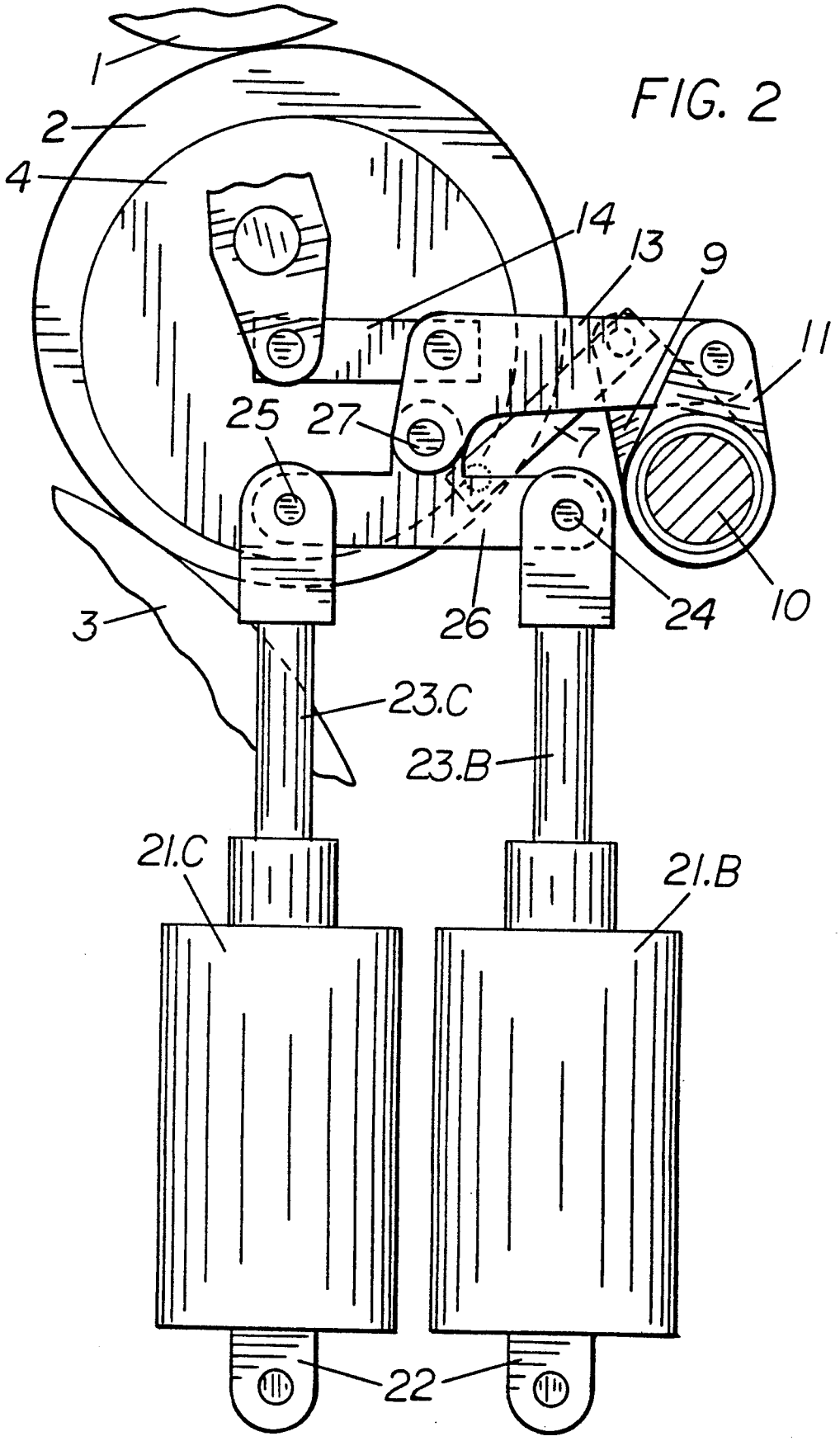

In accordance with the present invention, the toggle mechanism consisting of the links 13 and 14 is actuated by way of two parallel double-acting, fluid pressure working cylinders 21.B and 21.C (See FIG. 2). The pressure cylinders 21.B and 21.C each bear non-displaceably on the frame of the press by way of their base and pivot lugs 22. The piston rods 23.B and 23.C of the cylinders 21.B and 21.C are connected by way of pivot pins 24 and 25 to a cross link 26. In the preferred embodiment, the link 13 of the toggle linkage has a third pivot pin 27 through which it is pivotally connected to the cross link 26. Pursuant to the invention, the strokes of the cylinders 21.B and 21.C are so dimensioned that when they are in the extended state, the piston rods 23.B and 23.C act by way of the cross link 26 to press the toggle mechanism 13, 14 into its extended position, wherein the lug 5 is located at position A (See FIG. 1). The extended state of the piston rods 23.B and 23.C therefore corresponds to throw-on for printing.

In the preferred embodiment, the cylinders 21.B and 21.C are compressed air cylinders—i.e., pneumatic cylinders of an appropriate double-acting kind. It will be understood that the compressed air is supplied by a pressure pump on the press and conveyed through pressure lines to the cylinders. Desirably, compressed air accumulators are also provided. By way of electrically controllable valves, more particularly electrically operated solenoid valves, associated with the working chambers of the cylinders 21.B and 21.C, the piston rods 23.B and 23.C can be retracted and extended individually.

Alternatively, the cylinders 21.B and 21.C can take the form of hydraulic cylinders, in which event an appropriate hydraulic system produces the movements of the piston rods 23.B and 23.C. The advantage of the cylinders 21.B and 21.C being air-operated cylinders resides in the known fact that the compressed air can by way of electrically operated solenoid valves be simply discharged to atmosphere at the place where it ceases to be of use. On the other hand, a hydraulic system requires an elaborate return system for oil circulation to the pump. As is well known, compressed air is required at many places in modern sheet-fed offset presses, and so if the compressed air installation is of appropriate design it is a simple matter to incorporate the throw-on/throw-off device according to the present invention in the compressed air system of the press.

FIG. 2, like FIG. 1, shows the toggle mechanism 13, 14 in its extended position—i.e., the thrown-on position for printing. For this reason and because of the inhibiting effect of the bushings 4, the pressure between the blanket cylinder 2 and the impression cylinder 3 does not react in any way on the working cylinders 21.B and 21.C during the run-in and run-out of the gripper edges of the cylinders 2 and 3.

Figure 3:
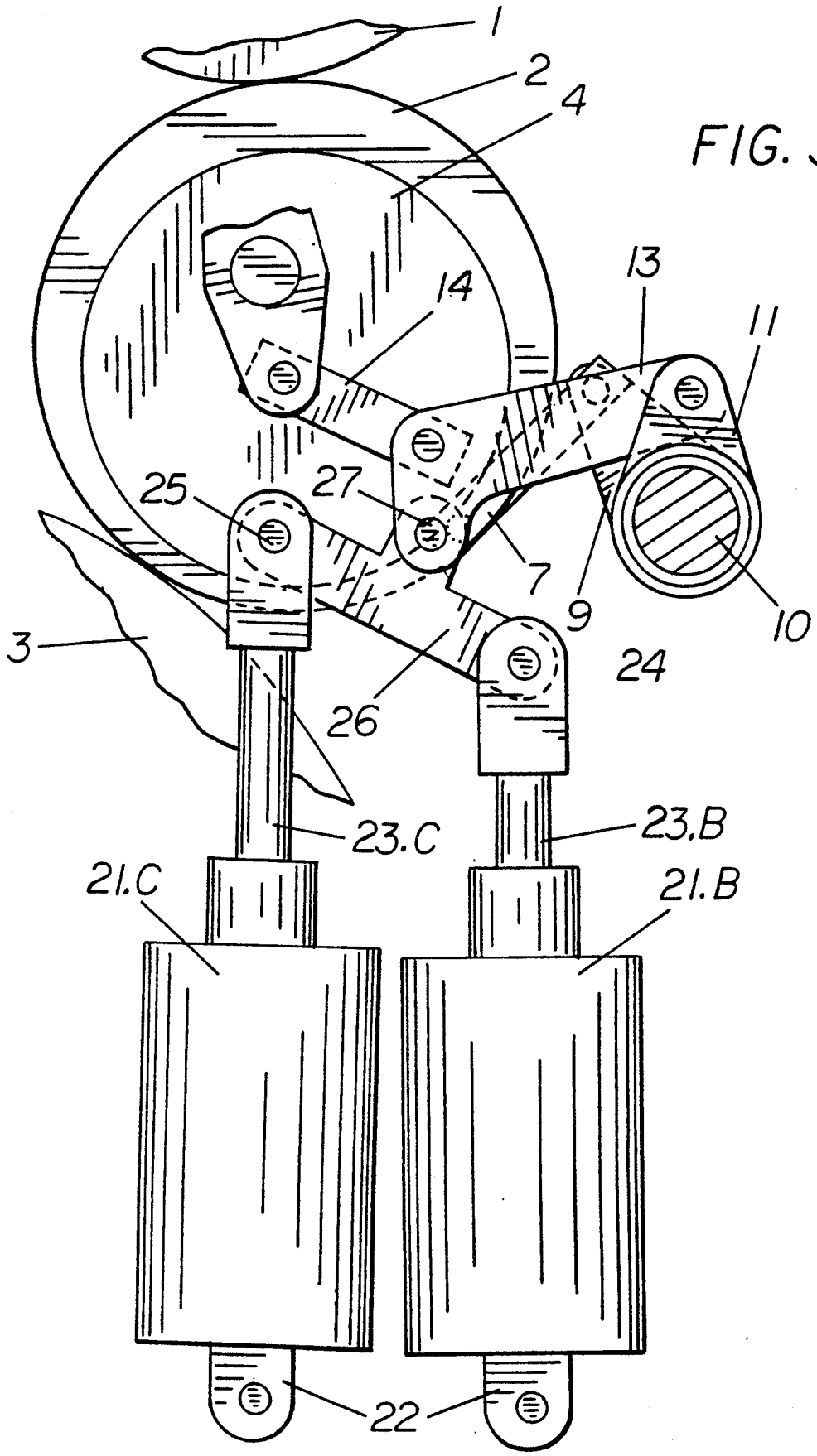
FIG. 3 shows the device according to the invention in the position in which the blanket cylinder has been thrown off the impression cylinder.

If it is required to throw off only the blanket cylinder 2 from the impression cylinder 3, for example, because a sheet is missing or arrives too late at the layers, the appropriate chamber of the cylinder 21.B is energized with compressed air by appropriate actuation of a solenoid valve so that the piston rod 23.B moves at maximum speed into its retracted position shown in FIG. 3.

FIG. 3 shows this thrown-off position while the blanket cylinder 2 remains thrown on to the plate cylinder 1. The toggle mechanism 13, 14 has been moved by the retracted piston rod 23.B and the cross link 26 pivoted down thereby into a bent or articulated position. By way of the shaft 10 and the lever 9, the bushing lug 5 has been rotated to position B (See FIG. 1). To throw on printing again, the corresponding chamber of the cylinder 21.B is energized with pressure medium. The piston rod 23.B therefore extends and acts by way of the cross link 26 to restore the toggle mechanism 13, 14 to its extended, essentially straight position.

During proper operation of the present invention, the blanket cylinder 2 is thrown on and thrown off the impression cylinder 3 (controlled by corresponding operating times for the appropriate solenoid valves) when the gripper edges of the blanket cylinder 2 and the impression cylinder 3 are opposite one another. The final sheet is therefore still fully printed and at throw-on the blanket cylinder 2 does not contact the impression cylinder 3 without a sheet being between them. Preferably, the operating times for the operations to be described hereinafter are derived from a system which detects the angular position of the press and upon corresponding instructions (stop printing, ink blanket, etc.) forms actuating signals for the solenoid valves. Such a system can be embodied by a high-resolution angular position detector which runs synchronously with the press and which has a computer disposed after it. The detector can be disposed on a one-revolution shaft of the sheet feeder of the press. A control system of this type is disclosed in previously mentioned copending application Ser. No. 690,654, filed Apr. 24, 1991, to which further reference may be made.

Starting from the position shown in FIG. 3, to throw the blanket cylinder 2 off the plate cylinder 1, the cylinder 21.C is operated so that the piston rod 23.C moves to its end position. This occurs while the gripper edges of the plate cylinder 1 and blanket cylinder 2 are opposite one another. The toggle mechanism 13, 14 moves into its downwardly articulated or completely bent position shown in FIG. 4. As FIG. 1 shows, the lug 5 of the bushing 4 has been rotated into position C.

Figure 4:
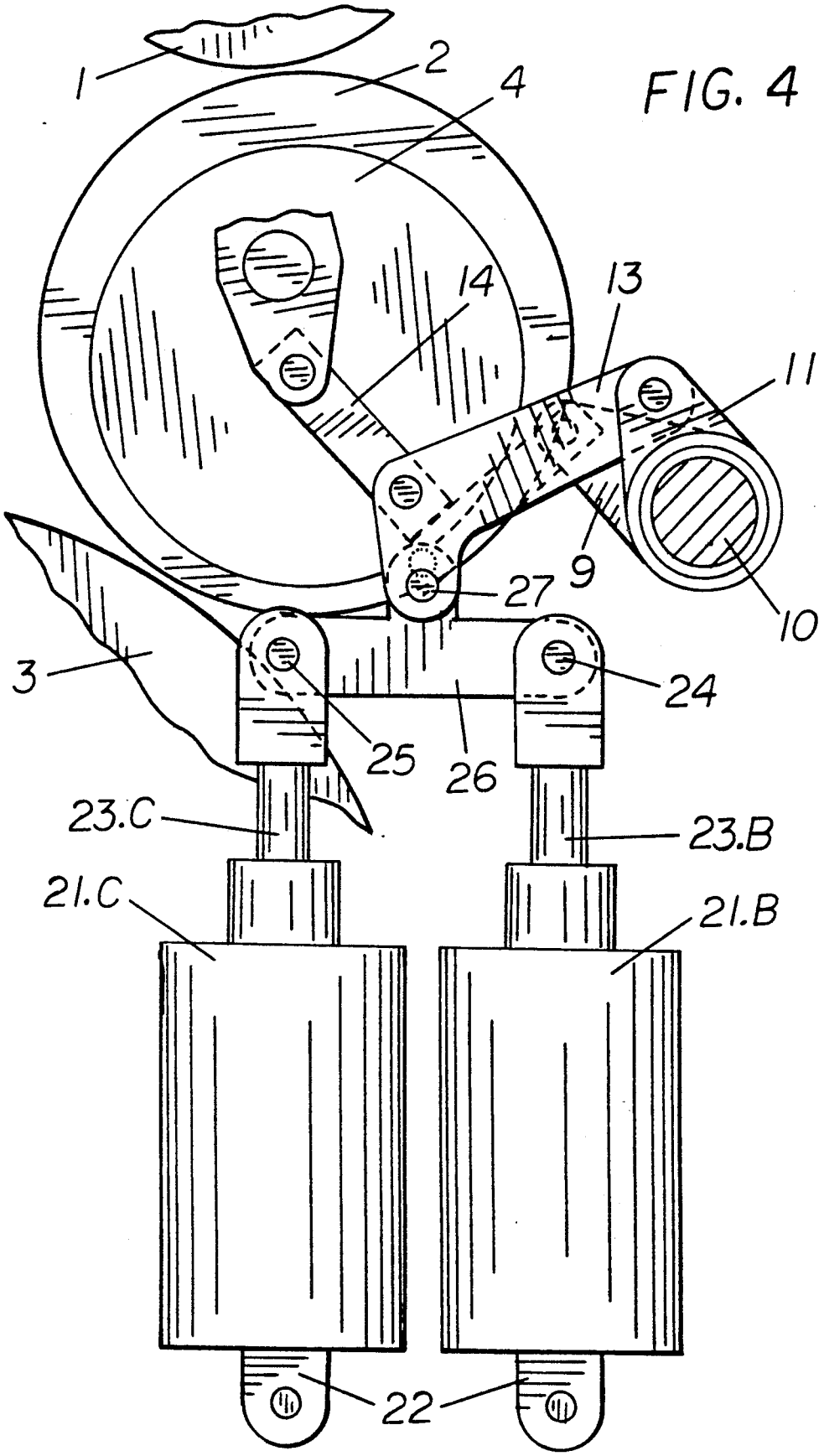
FIG. 4 shows the device according to the invention in the position in which the blanket cylinder has been thrown off the plate cylinder.

Throw-on, starting from the position of FIG. 4, proceeds in the reverse order. While the gripper edges of the cylinders 1 and 2 are opposite one another, the corresponding chamber of the cylinder 21.C is energized, the piston rod 23.C extends and acts by way of the cross link 26 to press the toggle mechanism 13, 14 into the position shown in FIG. 3. The blanket cylinder 2 is now in contact with the plate cylinder 1 and is inked.

Starting from the position shown in FIG. 3, to throw the blanket cylinder 2 on to the impression cylinder 3 when the first sheet for printing is disposed thereon, the corresponding chamber of the cylinder 21.B is actuated so that the piston rod 23.B moves into its end position. The toggle mechanism 13, 14 moves into its extended position to throw the blanket cylinder 2 on the impression cylinder 3.

The three positions hereinbefore described for the blanket cylinder 2 with respect to the plate cylinder 1 and impression cylinder 3 are associated with three positions of the pivot pin 27 corresponding to the angular positions of the toggle mechanism 13, 14, as shown in FIGS. 2 to 4. These three positions of the toggle mechanism—i.e., of the pivot pin 27—could in principle also be provided by a three-point working cylinder, which could be either pneumatic or hydraulic with appropriate triggering. Such a three-point working cylinder corresponds to a serial arrangement of two double-acting working cylinders in which the cylinder following the first working cylinder bears, for example, by way of its pivoted lug, on the piston rod of the first working cylinder. A three-point working cylinder of this kind would enable the three positions described for the pivot pin 27 to be approached in a generally completely equivalent way. However, the use of a three-point working cylinder has the following fundamental disadvantage. When the first cylinder has extended and when it is required to extend the second cylinder against a force, a developing force reacts completely on the first pressurized cylinder. Because of the compressibility of the pressure medium, and particularly in the case of compressed air, the first cylinder—i.e., its piston rod—yields considerably.

Such a three-point cylinder arrangement has a further disadvantage. Because of the consecutive, or series, arrangement of the two double-acting working cylinders their strokes—i.e., three approachable points—are additive but the forces of the cylinders are not. The simple reason for this is that the second working cylinder must bear on the first working cylinder which precedes it.

According to the present invention as hereinbefore described, the blanket cylinder 2 is thrown off the impression cylinder 3 when the piston rod 23.B retracts. Thus, the piston rod 23.B acts by way of the cross link 26 with a force-amplifying leverage to pull down the pivot pin 27 of the toggle mechanism 13, 14. (See FIGS. 2 and 3.) Simultaneously, the pin 25 acting as an abutment is being pressed upwards by the forces. The pin 25 therefore experiences a force parallel to the direction of the piston rod 23.C in such manner as to tend to pull the piston rod 23.C beyond its top end position. However, since its fully extended end position is a mechanical limit, it acts together with the cylinder 21.C as a rigid connection between the pivoted lug 22 and the pin 25. There is therefore no reaction on the cylinder 21.C in the sense of springing or yielding.

At present day high printing speeds, on the order of 20,000 sheets/hour, the phase of disengagement of the blanket cylinder 2 from the impression cylinder 3 is particularly critical as regards time. A disengagement which is too late—i.e., a disengagement occurring outside the gripper edge—for example, in the absence of a sheet, results in inking of the impression cylinder 3 and causes a prolonged downtime because of the necessary cleaning of the impression cylinder 3. It is therefore precisely in this phase that reactions, which are bound to occur with a three-point working cylinder and which are the result of the consecutive arrangement, have a particularly adverse effect on the reaction behavior. Since compressed air is highly compressible, the use of pneumatic three-point working cylinders is possible only with very high pressure systems and at very high cost.

Another advantage of a device according to the present invention is a possible actuation, not previously mentioned, having a very advantageous reaction behavior. If an irregularity is detected in sheet movement, for example, a double sheet transferred at the pre-gripper, printing must be stopped immediately by the blanket cylinder 2 being placed quickly at maximum distance from the impression cylinder 3. Such situations have absolute priority. It is impossible to use stepwise throw-off while the gripper edges of the plate cylinder 1, blanket cylinder 2 and impression cylinder 3 are in registration. A crease entering the printing zone or a double sheet at the pressure setting of the blanket cylinder 2 and the impression cylinder 3 would cause tremendous impacts in the bearings of the cylinders 2 and 3 and lead to damage. To obviate this, printing can be shut off when the grip edges of the blanket cylinder 2 and impression cylinder 3 are opposite one another by simultaneous energization of the cylinders 21.B and 21.C. The cross link 26 pulled by the piston rods 23.B and 23.C immediately moves the toggle mechanism 13, 14 from the position of FIG. 2 into the position of FIG. 4. Moreover, due to the parallel arrangement of the cylinders 21.B and 21.C, the pin 26 pulls with the sum of the forces of the piston rods 23.B and 23.C, yet this throw-off operation takes only the time required for one piston rod 23.B or 23.C to retract. Although a conventional three-point working cylinder (series arrangement) would provide the same speed advantage (addition of strokes) in the case of simultaneous energization of the correspondingly serially connected working chamber, it would not provide an addition of the forces produced therein. This arises automatically from the fact that the working chambers are in series with one another and so the strokes, but not the forces, are cumulative.

It will be appreciated, of course, that it is precisely at high printing speeds and the associated short time intervals (width of the gripper edges) in which the blanket cylinder must be thrown off, that substantial forces would be needed to throw off the blanket cylinder 2—i.e., to move it away from the other cylinders due to the inertia of the mass. Also, a force would have to be overcome when the bushing 4 moves from position A to position B in FIG. 1 since, due to the mounting of the eccentric bushing, the blanket cylinder 2 in this angular range is pressed more strongly on to the plate cylinder 1 (overpressing). In this angular range the distance between the axes of the plate cylinder 1 and blanket cylinder 2 decreases. To accommodate these substantial forces very rapidly at high printing speeds would require a three-point working cylinder designed specially for this particular case and it would be correspondingly expensive.

The throw-on and throw-off device according to the present invention, therefore, obviates an elaborate and therefore expensive three-point working cylinder of complex construction. Rather, it provides, in a simple manner, the use of two similar double-acting pressure-medium-energized working cylinders. Also, the disadvantages associated with the principle of a three-point working cylinder are not only obviated but are offset by the advantages of a parallel arrangement. Furthermore, a device according to the invention provides an advantageous reduction in size.

As previously mentioned and described in more detail in copending application Ser. No. 690,654, the throw-on and throw-off actuating times for the solenoid valves are generated by a system which detects the position of the printing unit cylinders by ensuring that the blanket cylinder 2 is thrown on and off the impression cylinder 3 and plate cylinder 1, respectively, when the gripper edges of the respective cylinders are opposite one another. The actuating times can be so chosen that the corresponding solenoid valves operate at the beginning of the period when the gripper edges of the cylinders register with one another—i.e., when the print end zones of the blanket cylinder 2 and impression cylinder 3 or of the blanket cylinder 2 and plate cylinder 1, respectively, are opposite one another.

However, since there is a period of dead time and reaction time until pressure medium has flowed into the working chambers, the necessary pressure has built up in the working chamber and the piston has therefore gradually accelerated to its maximum speed, the time at which, for example, the blanket cylinder 2 is thrown off the impression cylinder 3 varies with increasing printing speed towards the start of printing—i.e., it is displaced towards the end of the gripper edge. Also, the effect of a further increase in printing speed, for example, as regards the throwing-off from the impression cylinder 3 is that the blanket cylinder 2 has still not reached its end position when the gripper edges no longer register with one another and printing zones are already opposite one another. The blanket cylinder 2 might therefore be positioned relative to the impression cylinder 3 with too narrow a gap at the start of printing. Similar considerations apply to the throw-off of the blanket cylinder 2 from the plate cylinder 1 and for throwing-on. The latter effect occurs exactly at the printing rate when the sum of the dead time and reaction time is equal to the time during which the gripper edges of the printing unit cylinders are opposite one another.

The sum of the dead time and reaction time can be avoided by the correspondingly increased pressure medium energization—i.e., higher working pressures, but with the result of a more complicated and an elaborate and expensive design of such a more specialized pneumatic system.

This can be avoided to some extent at high printing speed if, as proposed by the present invention, the operating times for the solenoid valves are controlled by the system not only in dependence upon the position of the printing unit cylinders but also in dependence upon speed. The system therefore detects the speed of rotation of the press, for example, by way of a tachometer, or the actual speed of rotation of the control for the main drive of the press and generates correspondingly advanced operating times. In the case of a slow-running press the operating time for the corresponding throwing-on or throwing-off is disposed, for example, at the start of the period when the gripper edges of the cylinders register with one another, and is advanced in proportion to the speed at high printing rate—i.e., it is placed in the zone, for example, of the sheet still to be printed out—thus ensuring that the blanket cylinder 2 is always thrown on and thrown off in the zone where the gripper edges register with one another.

The angle of advance dependent on speed or printing rate can be proportional to speed of rotation or be selected according to an empirically determined characteristic. A system thus devised therefore further reduces the technical construction costs of a device for throwing on and throwing off according to the present invention.

We claim as our invention:

1. A throw-on and throw-off device for a blanket cylinder in the printing unit of an offset press having a plate cylinder and an impression cylinder, a press frame having bearings mounted thereon for journalling said cylinders and eccentric bushings supporting the ends of the blanket cylinder for throw-on and throw-off movement with respect to the plate cylinder and the impression cylinder comprising, in combination, means to provide rapid throw-off of said blanket cylinder from both said impression cylinder and said plate cylinder and to provide sequential throw-on of said blanket cylinder on said plate cylinder and on said impression cylinder, said means including:

a toggle linkage attached to the press frame for rotating said eccentric bushings, actuating means for articulating and straightening said toggle linkage, said actuating means including a pair of parallel, double-acting fluid pressure cylinders each mounted at one end on the press frame, said fluid pressure cylinders each having a slidable piston rod projecting from its other end, a cross link pivotally connected adjacent its ends to said respective piston rods, pivot means intermediate the ends of said cross link for connection with said toggle linkage, said pair of fluid pressure cylinders being operative incident to simultaneous pressurization thereof in one direction for articulating said toggle linkage to effectuate rapid throw-off of said blanket cylinder from both said plate cylinder and said impression cylinder and said pair of fluid pressure cylinders being operative incident to individual and consecutive pressurization thereof in an opposite direction for progressively straightening said toggle linkage to effectuate sequential throw-on of said blanket cylinder on said plate cylinder and on said impression cylinder, respectively.

2. A throw-on and throw-off device according to claim 1, wherein said toggle linkage is attached to the press frame by a pressure control lever mounted for pivoting around a pin secured to the press frame, and including means for pivoting the control lever to vary the pressure between the blanket cylinder and the impression cylinder.

3. A throw-on and throw-off device according to claim 1 wherein said double-acting fluid pressure cylinders are in the form of two similar pneumatic cylinders each having two chambers energizable with compressed air.

* * * * *